US005603752A

United States Patent [19]

Hara

[11] Patent Number: 5,603,752

[45] Date of Patent: Feb. 18, 1997

[54] ELECTROSTATIC PRECIPITATOR

[75] Inventor: Keiichi Hara, Tokyo, Japan

[73] Assignee: Filtration Japan Co., Ltd., Yamagata-ken, Japan

[21] Appl. No.: 455,033

[22] Filed: May 31, 1995

[30] Foreign Application Priority Data

Jun. 7, 1994 [JP] Japan ..... 6-148670

[51] Int. Cl.[6] ..... B03C 3/45

[52] U.S. Cl. ..... 96/39; 96/77; 96/93; 96/94; 96/97; 96/98

[58] Field of Search ..... 96/39, 98, 89–94, 96/97, 62, 87, 77–79; 361/226

[56] References Cited

U.S. PATENT DOCUMENTS

| | | | |
|---|---|---|---|
| 1,329,237 | 1/1920 | Frisbie | 96/62 |
| 1,356,462 | 10/1920 | Nesbit | 96/87 |
| 1,992,974 | 3/1935 | Thompson | 96/87 X |
| 2,737,258 | 3/1956 | Harlow | 96/87 |
| 2,852,092 | 9/1958 | Fruth et al. | 96/87 |
| 3,958,961 | 5/1976 | Bakke | 96/47 |
| 4,239,514 | 12/1980 | Junkers | 96/87 |
| 4,342,571 | 8/1982 | Hayashi | 96/76 |
| 4,375,364 | 3/1983 | Van Hoesen et al. | 96/87 |
| 4,722,743 | 2/1988 | Joy et al. | 96/93 X |
| 5,210,678 | 5/1993 | Lain et al. | 361/226 |
| 5,248,324 | 9/1993 | Hara | 96/97 X |

FOREIGN PATENT DOCUMENTS

| | | | |
|---|---|---|---|
| 614871 | 12/1926 | France . | |
| 372525 | 3/1923 | Germany . | |
| 429921 | 6/1926 | Germany . | |
| 1078096 | 3/1960 | Germany . | |
| 1275514 | 8/1968 | Germany . | |
| 2118803 | 11/1972 | Germany . | |
| 52-51172 | 4/1977 | Japan . | |
| 6-51312 | 2/1994 | Japan . | |
| 6-132548 | 5/1994 | Japan . | |
| 496639 | 12/1938 | United Kingdom | 96/93 |
| 995230 | 6/1965 | United Kingdom | 96/87 |
| 1528548 | 10/1978 | United Kingdom . | |

*Primary Examiner*—Richard L. Chiesa
*Attorney, Agent, or Firm*—Oliff & Berridge

[57] ABSTRACT

An electrostatic precipitator includes a dust-collecting electrode group and a discharge electrode group arranged in the recited order with respect to the gas flow direction of a gas to be treated in the electrostatic precipitator. The discharge electrode group includes a plurality of discharge electrodes, each of which is made of a rectangular metal plate. The longitudinal edges of each plate form semicircles, with a series of saw-toothed portions having tips protruding from between each pair of semicircles. The dust-collecting electrode group includes a plurality of dust-collecting electrodes, each of which is made of a chain suspended adjacent the discharge electrode group at a predetermined spacing. The chains of the dust-collecting electrode groups are suspended so that they can rock back and forth.

20 Claims, 9 Drawing Sheets

ELECTROSTATIC PRECIPITATOR

BACKGROUND OF THE INVENTION

1. Field of the Invention

The present invention relates to an electrostatic precipitator to be used in a power plant, a cement plant, an industrial waste incinerator, a road or a tunnel for removing floating particles or radioactive dust, or for cleaning indoor air.

2. Description of the Related Art

An electrostatic precipitator ionizes (charges) fine particle such as dust floating in a gas by applying a high voltage to the gas (or by a corona discharge). The charged particles may then be collected on dust-collecting electrodes of the electrostatic precipitators, by making use of an electric field, to remove the particles (hereinafter referred to as "dust") from the gas. An electrostatic precipitator can collect the particles of most kinds of solids and liquid highly efficiently. In addition, the maintenance and running of the electrostatic precipitator is relatively inexpensive because it has a simple construction and few moving parts. However, the electrostatic precipitator has drawbacks in that its entire structure is large-sized due to the large space where dust is collected, and its construction cost may be raised by expensive parts such as a DC high voltage supply or a high voltage insulator. In addition, its dust collecting performance is determined by the electric resistivity of the dust. (Reference should be made to pp. 1119 to 1121 of Handbook of Electric Engineering, edited by Association of Electricity and issued by OHM Co., Ltd. on Jul. 10, 1983).

The present inventor has already introduced small-sized electrostatic precipitators having a high dust collecting efficiency in the inventions described in Japanese patent Application No. Hei 6-51312 and Japanese patent Application No. Hei 6-132548. The features of those apparatus will be briefly described below.

The electrostatic precipitator shown in FIG. 7, includes rectangular plate shaped metal discharge electrodes 101 formed with a series of saw-toothed portions having tips 101*a* on the edges thereof; and dust-collecting electrodes 102 formed with a number of pores 102*a* in their faces. The dust-collecting electrodes 102 are arranged so that their faces are parallel, and the dust-collecting electrodes 102 are connected through spacers 103 (103*a*, 103*b* and 103*c*) to form dust-collecting electrode groups 104. The discharge electrodes 101 are also arranged so that their faces are parallel, and they are connected through spacers 105 (105*a* and 105*b*) to form discharge electrode groups 106. These dust-collecting electrode groups 104 and discharge electrode groups 106 are fixed to a frame (not shown) by means of screws 107 extending from the spacers 103 and 105. A gas carrying dust particles is introduced in the direction of the arrow into the apparatus.

This apparatus features pores 102*a* in the dust-collecting electrodes 102 that cause a current A from the discharge electrodes 101 to be centralized at portions other than the pores 102*a* on the dust-collecting electrodes 102, as indicated by the arrows in FIG. 8. This increases the current density at the solid portions of the dust-collecting electrodes 102. As a result, a high dust-collecting efficiency is achieved. In addition, an air flow is established through the pores 102*a* of the dust-collecting electrodes 102, as shown by the arrows in FIG. 9. Dust particles collected on the electrode are rubbed off by the air flow, which prevents deterioration of the dust collecting ability of the apparatus due to dust built-up.

On the other hand, the electrostatic precipitator shown in FIG. 10 is modified such that the dust-collecting electrodes 102 of FIG. 7 are replaced by steel pipes 108. These pipes 108 are supported by steel beams 109, which may be positioned at the upper, lower or intermediate portions of the pipes 108, if necessary. In this apparatus, the pipes 108, acting as the dust-collecting electrodes, have curved faces which causes collected dust particles to drop by their own weight before dust becomes highly deposited. As a result, the dust-collecting electrodes have their surfaces covered with the dust for only short time periods, and the dust collecting efficiency of the apparatus is enhanced.

Because the electrostatic precipitator shown in FIG. 7 is assembled using numerous spacers, the high number of parts seriously increases the number of steps required for assembly. In addition, because the dust-collecting electrodes have to be manufactured into the desired shape before being attached, their manufacturing steps are troublesome. In the apparatus shown in FIG. 10, on the other hand, the steel beams 109 have to be prepared because they are used to support the pipes 108.

SUMMARY OF THE INVENTION

The present invention has been conceived in view of the problems thus far described. It is an object of the present invention to provide an electrostatic precipitator which has a high dust collecting efficiency, which is easily manufactured, and which is easily assembled.

Although the prior art apparatus described above can achieve a considerably high dust collecting efficiency, the present invention is intended to achieve even higher efficiencies.

In order to achieve the above-specified objects, an electrostatic precipitator according to the present invention includes a dust-collecting electrode group and a discharge electrode group, the dust-collecting electrode group being arranged at an upstream side of the electrostatic precipitator. The discharge electrode group includes a plurality of rectangular plate shaped metal discharge electrodes having opposite vertical edges punched into semicircles to form a series of saw-toothed portions. The dust-collecting electrode group includes a plurality of dust-collecting electrodes, each made of a chain suspended to confront the discharge electrode group at a predetermined spacing. The chains are allowed to rock back and forth with respect to the discharge electrode group.

In the present invention, moreover, a plurality of discharge electrode groups or dust-collecting electrode groups may be provided.

In the apparatus of the present invention, a high voltage is applied between the discharge electrodes and the dust-collecting electrodes so that an electric current is established by the corona discharge. When a gas carrying dust particles is introduced into the portion of the apparatus having the dust-collecting electrode group and the discharge electrode group, the dust in the gas is charged and attracted by the dust-collecting electrodes. If the dust-collecting electrodes are comprised of chains, these chains have a complicated three-dimensional shape that makes the spacing between the discharge electrodes and the dust-collecting electrodes prominently different, depending upon the location, so that a non-uniform electric field is established. In addition, because the chains are stereoscopic and have faces that project in various directions, they are liable to receive a discharge current from several discharge electrodes such that the current densities on the individual faces forming the chains are enhanced as a whole. As a result, the chains acquire complicated high current intensities along their surface shapes. Moreover, because the chains are suspended in a rocking manner, the positions of the links with respect to one another can freely change.

In the present invention, furthermore, a plurality of the dust-collecting electrode groups and discharge electrode groups may be provided along the gas flow direction so that adjoining electrodes exert influences upon each other, thus enhancing the dust-collecting ability of the apparatus.

DESCRIPTION OF THE PREFERRED EMBODIMENT

The present invention will be described below with reference to the accompanying drawings.

Figure 1:
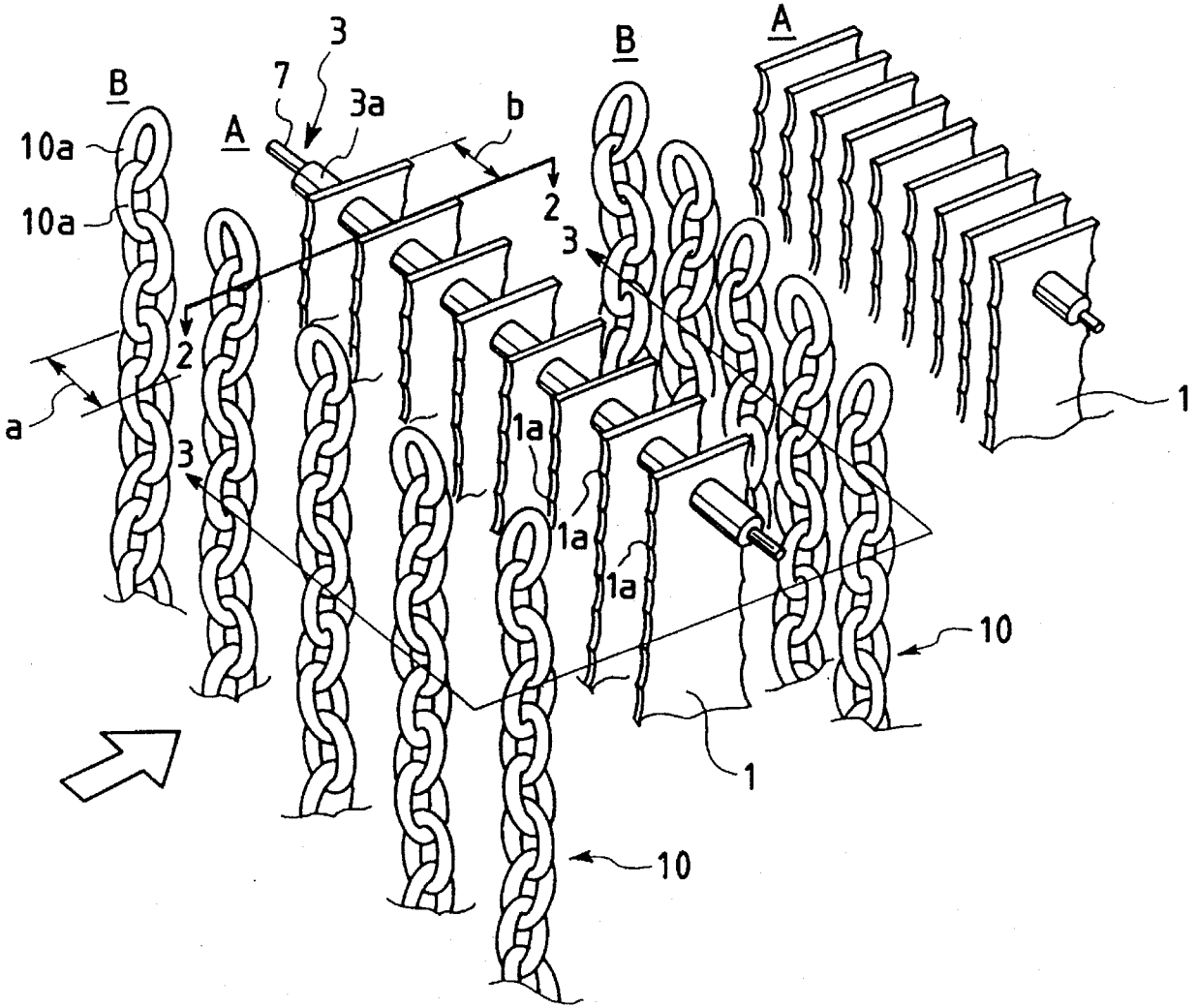
FIG. 1 is a perspective view showing an essential portion of an electrostatic precipitator according to an embodiment of the present invention.

FIG. 1 shows the discharge electrode groups and the dust-collecting electrode groups B of a portion of an entire electrostatic precipitator. The discharge electrode groups A are comprised of discharge electrodes 1 which are formed by punching semicircles in the two longer edges of rectangular metal plates to form a series of saw-toothed portions having pointed tips l*a*. On the other hand, the dust-collecting electrode groups B are comprised of dust-collecting electrodes 10, each of which is formed of a chain comprised of a plurality of links (made of a steel rod having a diameter of 6 to 8 mm). The chains are suspended adjacent one another in a line parallel to the discharge electrode group. Moreover, the discharge electrode groups A and the dust-collecting electrode groups B are paired so that they are provided in a plurality of pairs, as necessary.

The discharge electrodes of a discharge electrode group A are supported by the spacers 3 (3*a*). The individual dust-collecting electrodes 10 of a dust-collecting electrode group B are suspended by hooks (not shown) disposed on a support frame so that they hang vertically downward. As a result, the dust-collecting electrodes 10 can be freely turned and rocked.

The chains comprising the dust-collecting electrodes 10 are prepared merely by cutting commercially available chains to a desired length and need not be subjected to any special treatment prior to their attachment. If necessary, moreover, the dust-collecting electrodes 10 may also have their lower ends fixed. It should be noted that the individual links 10a are not prevented from relative movement at their nodes (connected portions of the links) by fixing the upper and lower ends of the chains to a support frame.

An electrostatic precipitator having discharge electrodes 1 with the aforementioned tips 1*a* of the saw-toothed portions, and dust-collecting electrodes 10 made of the chains, allows the corona voltage to be approximately 7 KV. This is much smaller than the voltage used in prior art electrostatic precipitator, typically 15 KV, and allows for a greater current. Moreover, the semicircular portions on the edges of the discharge electrodes 1 between the tips 1*a* can act to repel the charged dust against the gas flow.

Figure 2:
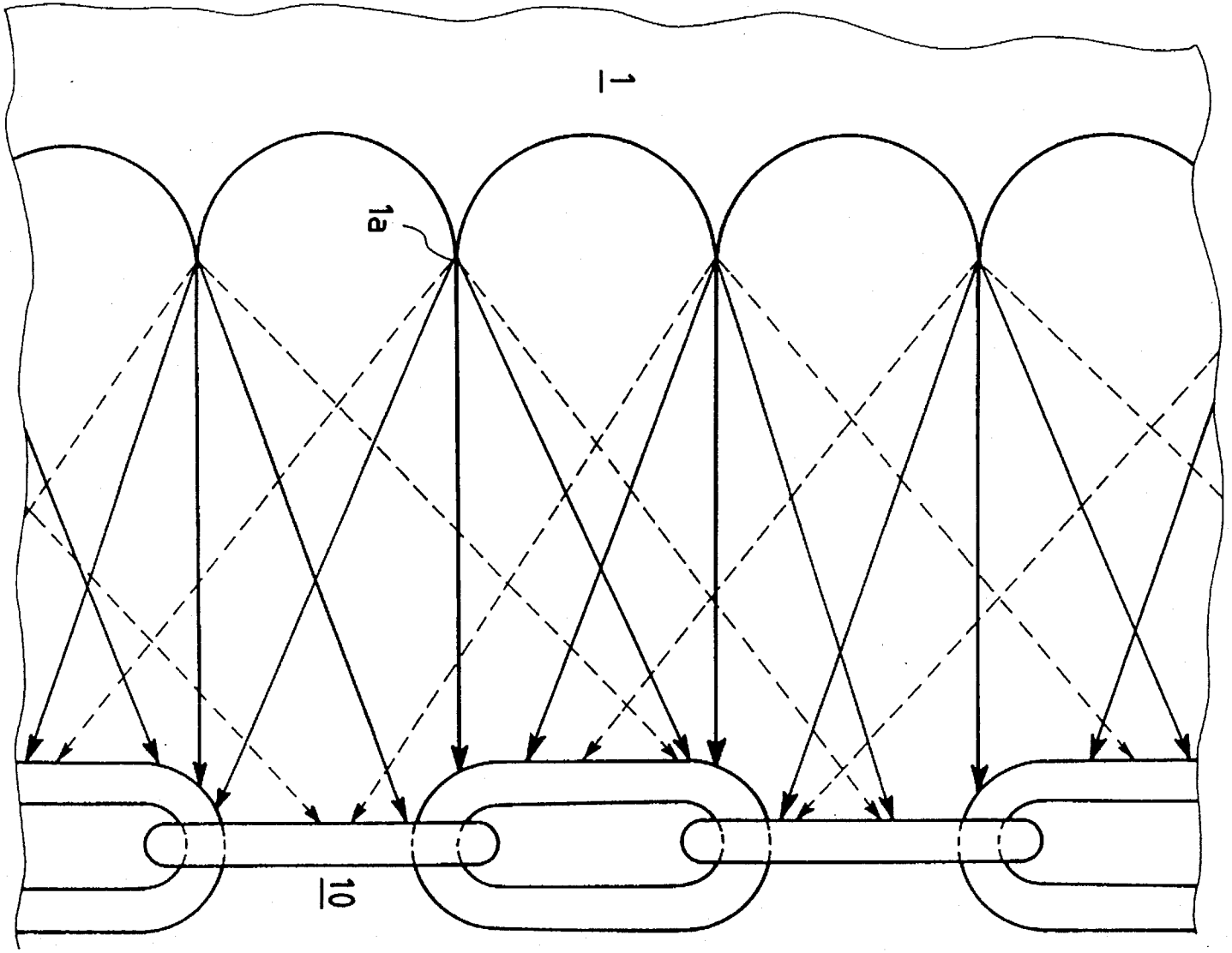
FIG. 2 is a sectional view taken along sectional lines 2—2 of FIG. 1, and showing lines of electric field intensity.
Figure 3:
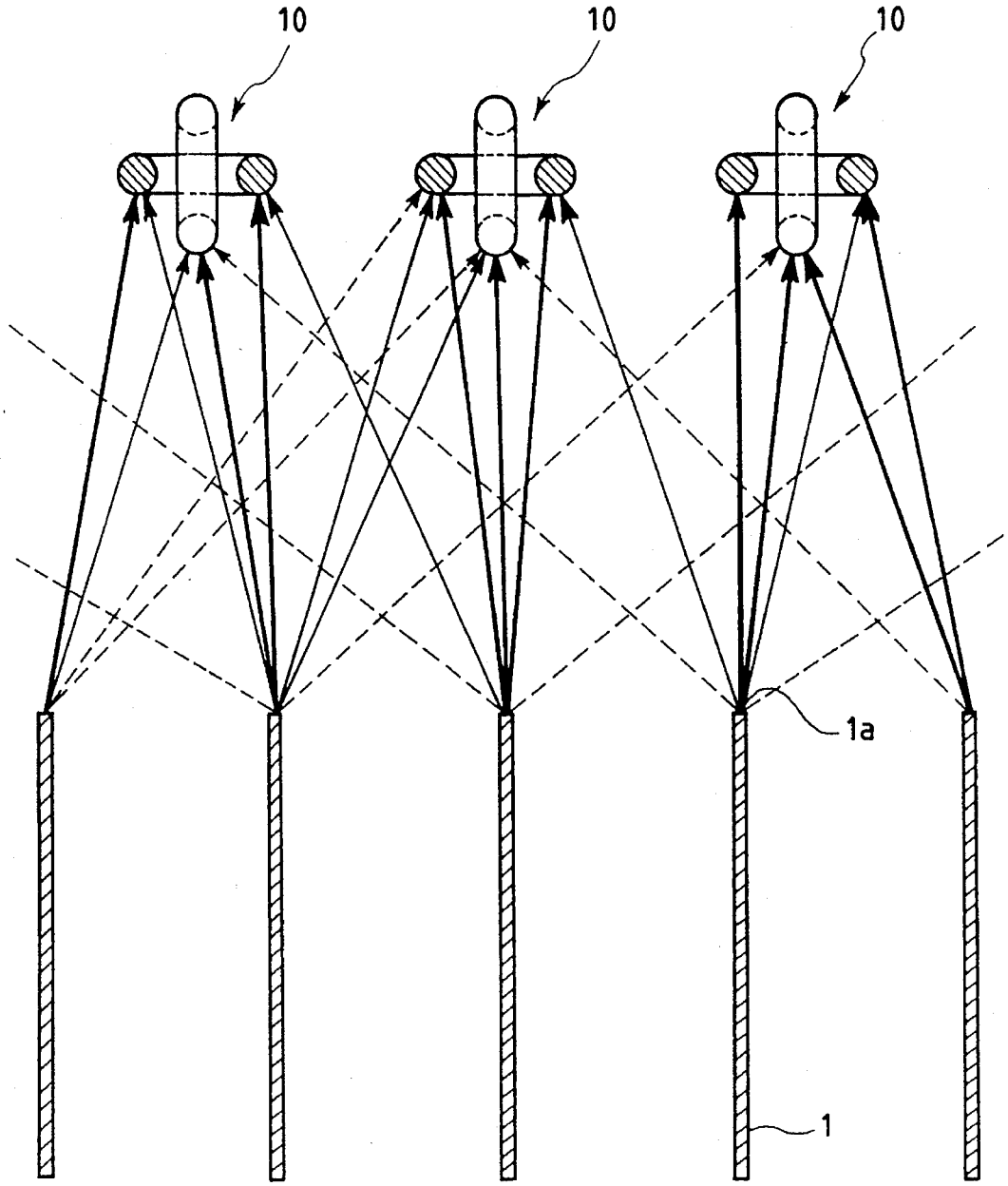
FIG. 3 is a sectional view taken along sectional lines 3—3 of FIG. 1, and showing lines of electric field intensity.

From the standpoint of the efficiency of the electrostatic precipitator, the discharge electrodes 1 are disposed such that the spacing a of the dust-collecting electrodes 10 is about two times (or a standard value) as large as the gap b of the immediately downstream discharge electrodes. FIG. 2 is a sectional view taken along lines 2—2 of FIG. 1. The current intensities from the saw-toothed tips 1*a* of the individual discharge electrodes 1 to the surfaces of the dust-collecting electrodes 10 are schematically illustrated by different kinds of arrows. Specifically, thick-line arrows indicate high currents; thin-line arrows indicate low currents; and dotted-line arrows indicate still lower currents. Likewise, a sectional view showing a portion, as taken along the sectional line 3—3 of FIG. 1, is shown in FIG. 3. The thick, thin and broken-line arrows appearing in FIG. 3 indicate the intensities of the currents as in FIG. 2.

Figure 4:
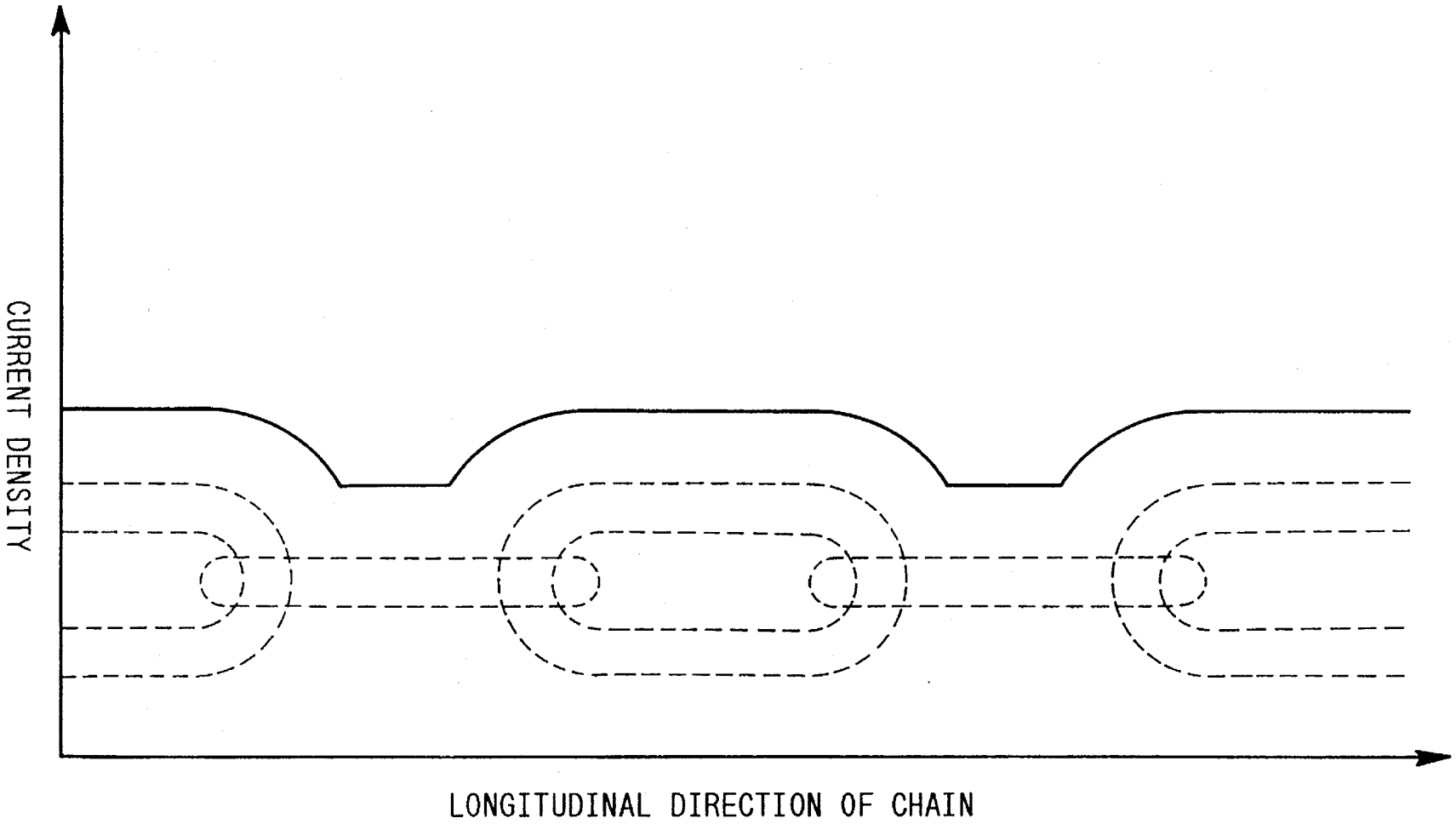
FIG. 4 is a schematic diagram showing the strength of the current intensity which is established in a chain forming a dust-collecting electrode.

When a high voltage is applied between the discharge electrodes 1 and the dust-collecting electrodes 10, a corona discharge is established therebetween so that a current flows from the discharge electrodes 1 to the dust-collecting electrodes 10, as shown in FIGS. 2 and 3. Because the chains acting as the dust-collecting electrodes 10 have complicated three-dimensional surface shapes, a non-uniform electric field is easily built up. Moreover, some surfaces of the dust-collecting electrodes 10 are influenced by the discharge current from several of the discharge electrodes, so that a current having a substantially uniform intensity is established along the undulations of the chains, as shown in FIG. 4.

Figure 5:
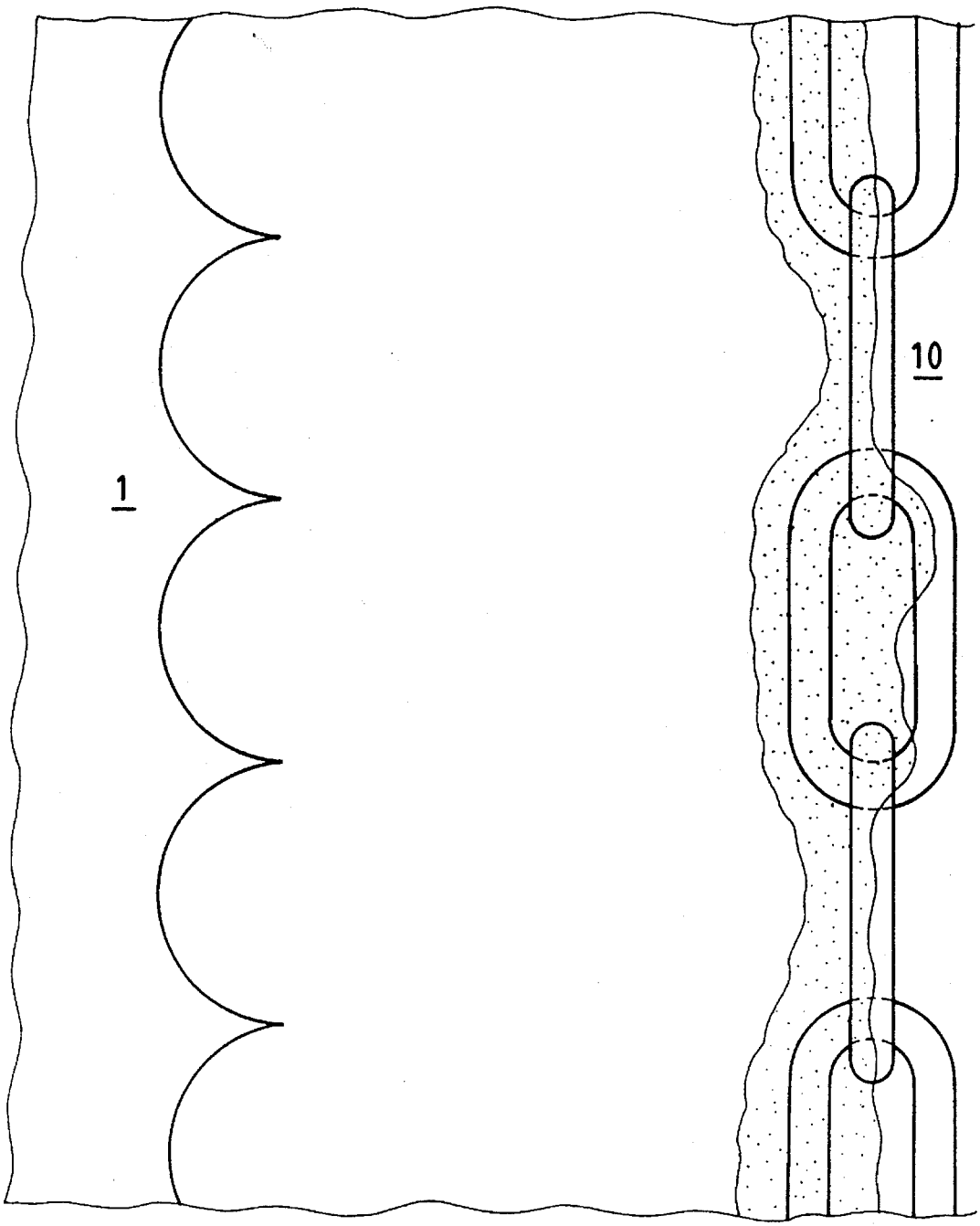
FIG. 5 is a sectional view taken along sectional lines 2—2 of FIG. 1 and showing the deposition state of dust on the chain.
Figure 6:
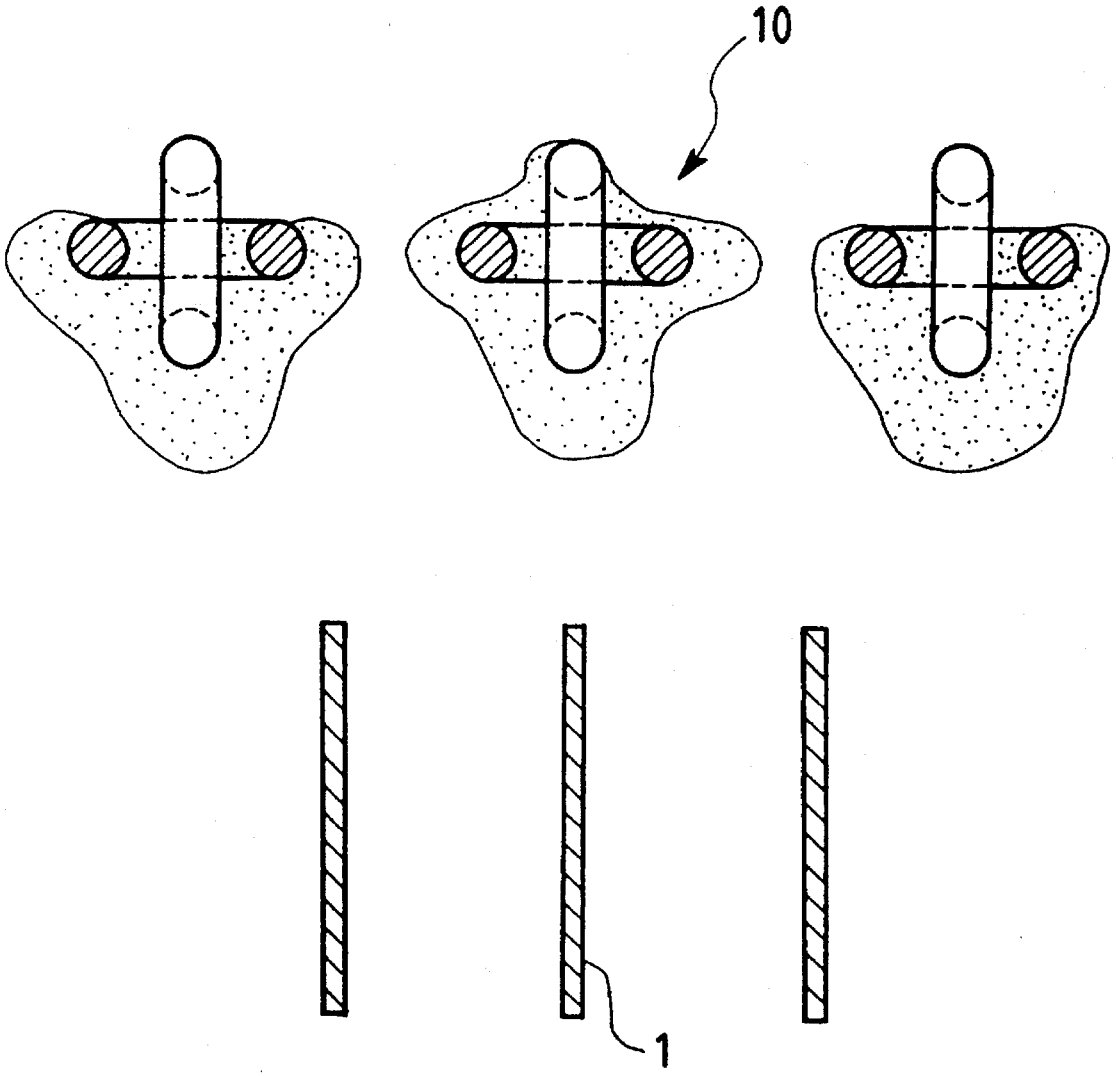
FIG. 6 is a sectional view taken along sectional lines 3—3 of FIG. 1 and showing the deposition state of dust on the chain.
Figure 7:
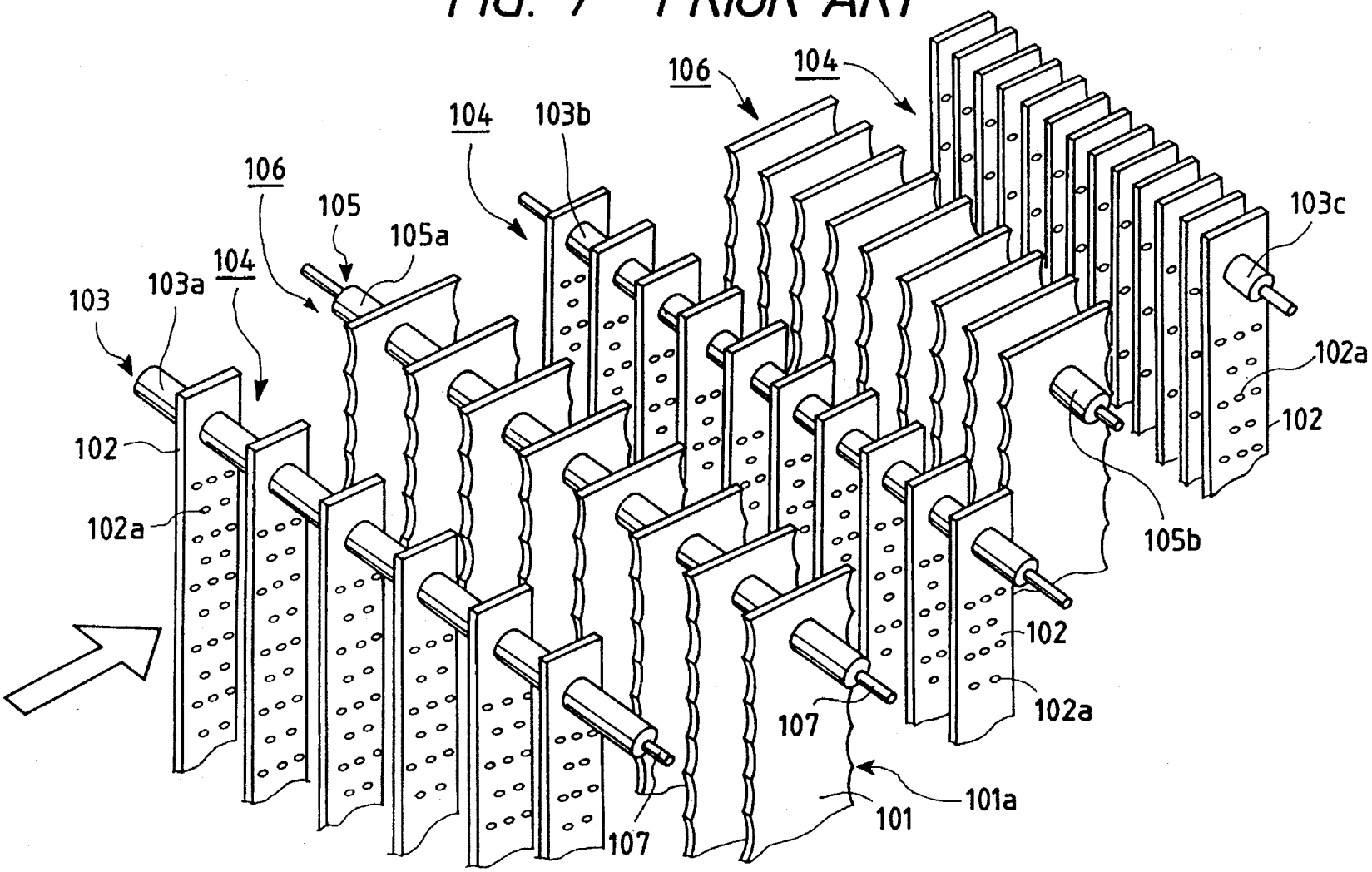
FIG. 7 PRIOR ART
FIG. 7 is a perspective view showing the discharge electrodes and the dust-collecting electrodes of an electrostatic precipitator of the prior art.
Figure 8:
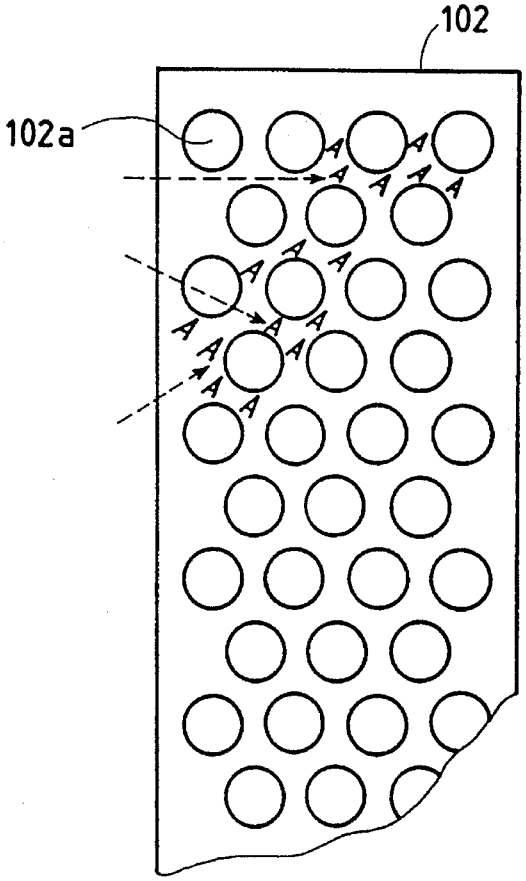
FIG. 8 PRIOR ART
FIG. 8 is a schematic diagram showing the current to be established in the dust-collecting electrodes shown in FIG. 7.
Figure 9:
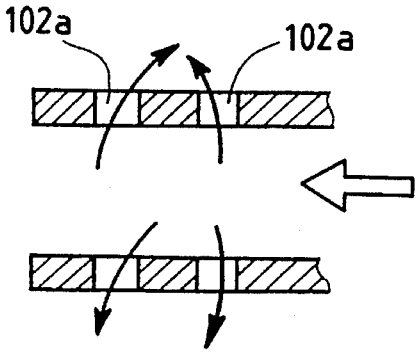
FIG. 9 PRIOR ART
FIG. 9 is a transverse section of the dust-collecting electrodes shown in FIG. 7.
Figure 10:
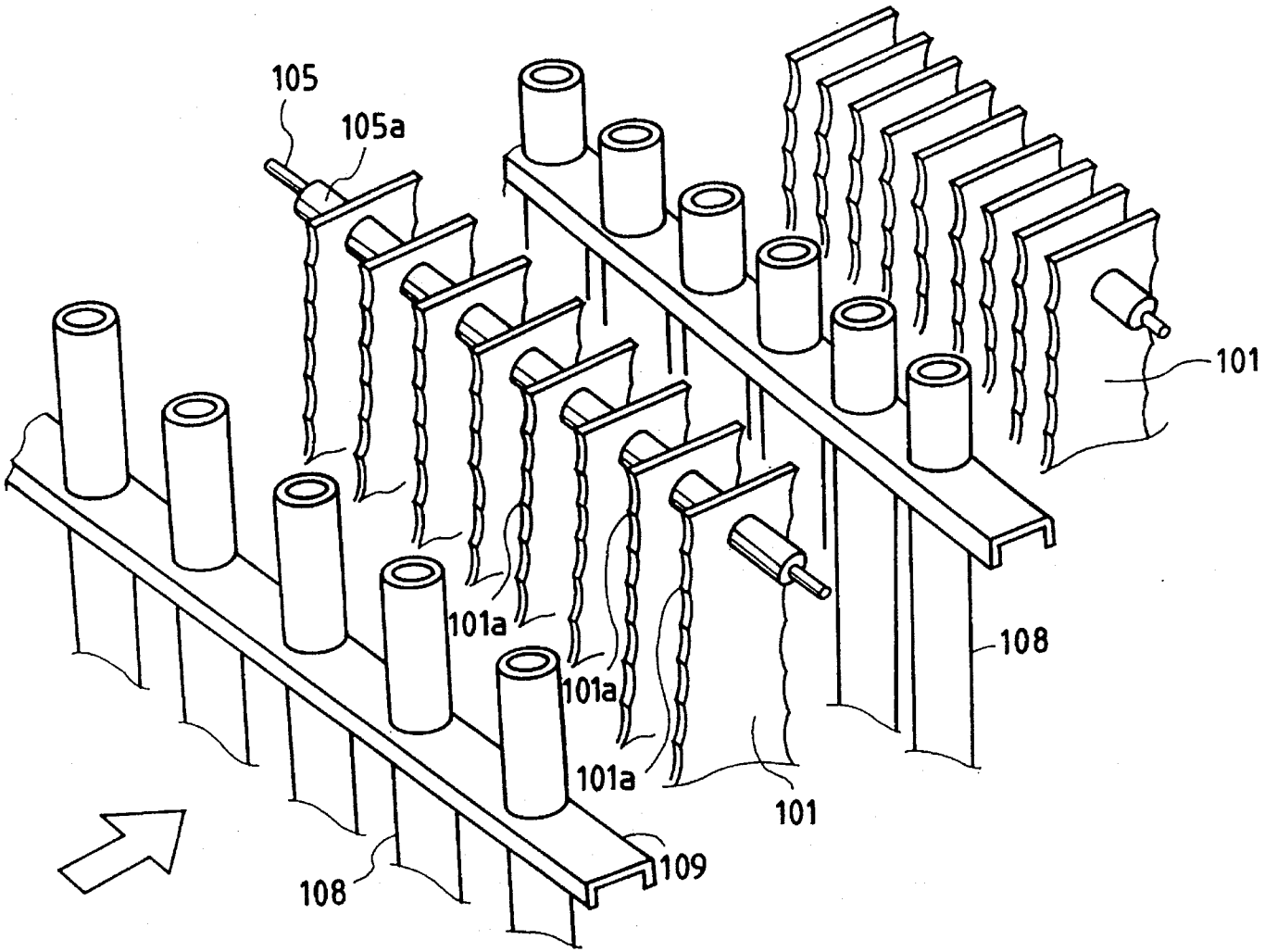
FIG. 10 PRIOR ART
FIG. 10 is a perspective view showing the discharge electrodes and the dust-collecting electrodes of an electrostatic precipitator of the prior art.

When a gas carrying dust is introduced into the electrostatic precipitator, as indicated by the arrow of FIG. 1, the dust in the gas is charged as it passes between the first discharge electrode group and the first dust-collecting electrode group. The charged dust is then collected by the dust-collecting electrodes 10. Because a substantially average current intensity prevails in the chains, the dust is collected, as shown in FIG. 5, substantially uniformly from the top to the bottom of the dust-collecting electrodes 10 along their surface shapes. As shown in FIG. 6, the dust is deposited such that the dust fills the inside of the links 10*a* of the chains. Moreover, the links 10*a* comprising the chains are allowed to individually rock (reciprocate) so that they are easily turned by the gas flowing through the apparatus. As a result, there is no back or leeward face of the dust-collecting electrodes 10, and dust is deposited on all sides of the chains.

Because of the establishment of the aforementioned current density and fact that the dust-collecting electrodes 10 have complicated three-dimensional shape, the dust is not thickly deposited, even if it is collected. In addition, because the links 10a of the chains are allowed to freely rock so that the links shift their positional relations, the deposited dust is forced to fall off of the surfaces of the chains. In addition, the drop of the collected dust from the dust-collecting electrodes 10 is caused not only by the rocking motions of the chains, but also by the shock of the spark discharge from the discharge electrodes 1 to the dust-collecting electrodes 10. As a result, no substantial operation is required for scraping (dropping) the dust through the use of a hammering means.

Under the construction thus far described, the present invention has the advantages described below. Because the chains used as dust-collecting electrodes may be commercially available ones that do not require any additional modification for use, the cost and time required to manufacture the electrostatic precipitator can be drastically reduced.

Moreover, an electrostatic precipitator of the present invention has its electrode weight reduced to 30 to 40% of the weight of conventional electrodes, which use plate-shaped dust-collecting electrodes. In addition, because the chains have a complicated three-dimensional shape, the spacing between the discharge electrodes and the dust-collecting electrodes varies from place to place along the electrodes such that a non-uniform electric field can be easily established. Furthermore, the current density may be increased as a result of the current concentration. Furthermore, because the chains are stereoscopic and have the variously directed faces, they are susceptible to discharge current from more than one discharge electrode, and the current density in the individual faces composing the chains is increased as a whole. As a result, the chains have a complicated high current intensity along their surface shapes. As a result of all these factors, the electrostatic precipitator has a high dust collecting capacity.

Because the chains are suspended in the rocking manner, the links comprising the chains can freely change their positional relations and are vibrated by the pressure of the gas to be treated, such that the deposited dust is easily dropped by the vibration. As a result, the high dust collecting capacity can be maintained for a long period of time without any dust removing operation using hammering or the like.

Moreover, by arranging a plurality of stages of the dust-collecting electrode groups and discharge electrode groups along the gas flow direction, according to the present invention, adjoining electrodes exert influences upon each other to enhance the dust collecting capacity of the electrostatic precipitator so that the electrostatic precipitator can be small-sized.

What is claimed is:

1. An electrostatic precipitator, comprising:

at least one dust-collecting electrode group, each dust-collecting electrode group comprising a plurality of dust-collecting electrodes arranged in a plane and spaced at a uniform spacing from one another, each dust-collecting electrode comprising a freely movable chain having a plurality of links; and at least one discharge electrode group, each discharge electrode group comprising a plurality of flat elongated discharge electrodes arranged in a plane substantially parallel to the plane of the at least one dust-collecting electrode group, the plurality of discharge electrodes of each discharge electrode group being spaced at a uniform spacing from one another and arranged parallel to one another and substantially parallel to a gas flow direction of a gas flowing through the electrostatic precipitator, wherein movement of a gas through the electrostatic precipitator causes deformation of the dust-collecting electrodes, the deformation causing collected dust to fall off the dust-collecting electrodes.

2. The electrostatic precipitator of claim 1, further comprising a frame, wherein each dust-collecting electrode is movably suspended on the frame, each dust-collecting electrode being movable relative to the at least one discharge electrode group in response to movement of a gas flowing through the electrostatic precipitator.

3. The electrostatic precipitator of claim 2, wherein a first end of each dust-collecting electrode is attached to the frame.

4. The electrostatic precipitator of claim 3, wherein a second end of each dust-collecting electrode is attached to the frame.

5. The electrostatic precipitator of claim 1, wherein the plurality of links of each chain are movable with respect to one another.

6. The electrostatic precipitator of claim 1, wherein each dust-collecting electrode has a non-uniform surface such that a magnitude of a spacing between the surface and adjacent discharge electrodes varies depending on the position of the surface on the dust-collecting electrode.

7. The electrostatic precipitator of claim 6, wherein a voltage applied between the at least one discharge electrode group and the at least one dust-collecting electrode group causes a discharge current to flow between the discharge electrode and the dust-collecting electrodes, a magnitude of a current density along the surface of each dust-collecting electrode varying in response to the varying spacing between the surface of the dust-collecting electrode and adjacent discharge electrodes.

8. The electrostatic precipitator of claim 1, wherein the discharge electrodes are substantially rectangular flat plates having saw-toothed portions at upstream and downstream edges thereof.

9. The electrostatic precipitator of claim 1, wherein a dust-collecting electrode group is arranged upstream of the upstream-most discharge electrode group in the gas flow direction.

10. The electrostatic precipitator of claim 9, wherein the at least one dust-collecting electrode group comprises a plurality of dust-collecting electrode groups, and wherein the at least one dust-collecting and discharge electrode groups are mounted on the frame in an alternating fashion in the gas flow direction.

11. The electrostatic precipitator of claim 1, wherein the spacing between the dust-collecting electrodes of each dust-collecting electrode group is greater than the spacing between the discharge electrodes of an adjacent downstream discharge electrode group.

12. The electrostatic precipitator of claim 11, wherein the plurality of links of each chain are movable with respect to one another in response to movement of a gas flowing through the electrostatic precipitator, and wherein the movement of the links of each chain cause collected dust to fall off the chains.

13. An electrostatic precipitator, comprising:

a frame;

at least one dust-collecting electrode group mounted on the frame, each dust-collecting electrode group comprising a plurality of freely movably mounted deformable dust-collecting electrodes arranged in a plane and spaced at a uniform spacing from one another; and at least one discharge electrode group mounted on the frame, each discharge electrode group comprising a plurality of flat elongated discharge electrodes arranged in a plane substantially parallel to the plane of the at least one dust-collecting electrode group, the plurality of discharge electrodes of each discharge electrode group being spaced at a uniform spacing from one another and arranged parallel to one another and substantially parallel to a gas flow direction of a gas flowing through the electrostatic precipitator, wherein movement of a gas through the electrostatic precipitator causes deformation of the dust-collecting electrodes, the deformation causing collected dust to fall off the dust-collecting electrodes.

14. The electrostatic precipitator of claim 13, wherein each dust-collecting electrode comprises a plurality of links, the links being freely movable with respect to one another.

15. The electrostatic precipitator of claim 13, wherein movement of a gas through the electrostatic precipitator causes movement of the dust-collecting electrodes relative to the discharge electrodes.

16. The electrostatic precipitator of claim 13, wherein the discharge electrodes are substantially rectangular flat plates having saw-toothed portions at upstream and downstream edges thereof.

17. The electrostatic precipitator of claim 13, wherein the magnitude of a spacing between the surface of each dust-collecting electrode and adjacent discharge electrodes varies depending on the position of the surface on the dust-collecting electrodes.

18. The electrostatic precipitator of claim 17, wherein a voltage applied between the at least one discharge electrode group and the at least one dust-collecting electrode group causes a discharge current to flow between the discharge electrodes and the dust-collecting electrodes, a magnitude of a current density along the surface of each dust-collecting electrode varying in response to the varying spacing between the surface of the dust-collecting electrode and adjacent discharge electrodes.

19. An electrostatic precipitator, comprising:

a frame;

at least one dust-collecting electrode group mounted on the frame, each dust-collecting electrode group comprising a plurality of movably mounted deformable dust-collecting electrodes arranged in a plane and spaced at a uniform spacing from one another; and at least one discharge electrode group mounted on the frame, each discharge electrode group comprising a plurality of flat elongated discharge electrodes arranged in a plane substantially parallel to the plane of the at least one dust-collecting electrode group, the plurality of discharge electrodes of each discharge electrode group being spaced at a uniform spacing from one another and arranged parallel to one another and substantially parallel to a gas flow direction of a gas flowing through the electrostatic precipitator;

wherein the spacing between the dust-collecting electrodes of each dust-collecting electrode group is greater than the spacing between the discharge electrodes of an adjacent downstream discharge electrode group.

20. The electrostatic precipitator of claim 19, wherein movement of a gas through the electrostatic precipitator causes movement of the dust-collecting electrodes relative to the discharge electrodes.

* * * * *